US007891640B2

(12) United States Patent
Price

(10) Patent No.: US 7,891,640 B2
(45) Date of Patent: Feb. 22, 2011

(54) FENCE STRETCHER SYSTEM

(76) Inventor: Donald J. Price, 258 Dewitt Owens Rd., Rutherfordton, NC (US) 28139

( * ) Notice: Subject to any disclaimer, the term of this patent is extended or adjusted under 35 U.S.C. 154(b) by 0 days.

(21) Appl. No.: 12/475,106

(22) Filed: May 29, 2009

(65) Prior Publication Data

US 2010/0301291 A1 Dec. 2, 2010

(51) Int. Cl.
*B25B 25/00* (2006.01)
*B21F 9/00* (2006.01)

(52) U.S. Cl. ..... 254/245; 254/199; 254/231; 254/237; 254/243; 294/132

(58) Field of Classification Search ..... 254/199, 254/213, 217, 222, 224, 231, 237, 243, 245, 254/246; 294/132, 132 R, 133; 24/127; 43/7, 8

See application file for complete search history.

(56) References Cited

U.S. PATENT DOCUMENTS

| | | | | | |
|---|---|---|---|---|---|
| 437,548 | A * | 9/1890 | Anderson | 24/127 |
| 1,018,313 | A * | 2/1912 | Goolsby | 294/133 |
| 1,185,212 | A * | 5/1916 | Leverich | 294/132 |
| 1,223,709 | A * | 4/1917 | Mattox | 294/132 |
| 1,387,338 | A * | 8/1921 | Ball | 254/219 |
| 1,426,527 | A * | 8/1922 | Weller | 294/132 |
| 1,427,952 | A * | 9/1922 | Hague | 254/236 |
| 1,462,011 | A * | 7/1923 | Hutcherson | 254/296 |
| 1,896,447 | A * | 2/1933 | Hammer | 294/132 |
| 2,153,748 | A * | 4/1939 | Frederick | 294/104 |
| 2,732,176 | A * | 1/1956 | Martin | 294/132 |
| 3,026,017 | A * | 3/1962 | Hopkins | 383/13 |
| 3,211,426 | A * | 10/1965 | Handley | 294/132 |
| 3,881,690 | A * | 5/1975 | Combs, Jr. | 294/133 |
| 3,949,968 | A * | 4/1976 | Verhelst | 254/213 |
| 4,046,353 | A * | 9/1977 | Buschmann | 294/133 |
| 4,061,387 | A * | 12/1977 | Lindbergh | 294/26 |
| 4,209,920 | A * | 7/1980 | Hebert | 37/316 |
| 4,298,185 | A | 11/1981 | Janssen | 256/41 |
| 5,078,365 | A | 1/1992 | Fultz | 256/1 |
| D361,934 | S * | 9/1995 | Croteau | D9/434 |
| 5,660,099 | A * | 8/1997 | Figueira, Jr. | 99/337 |
| D400,636 | S * | 11/1998 | High | D22/134 |
| D463,128 | S * | 9/2002 | Berke et al. | D3/328 |
| 7,213,851 | B2 * | 5/2007 | Mann | 294/26 |
| 2009/0014698 | A1 * | 1/2009 | Herrington et al. | 254/199 |

* cited by examiner

*Primary Examiner*—Evan H Langdon
(74) *Attorney, Agent, or Firm*—MacCord Mason PLLC

(57) ABSTRACT

A fence stretcher system and method are shown and described. In one embodiment, the fence stretcher system comprises a body. A rod having a diameter configured to allow the rod to be woven into a fence's links may be attached to the body. A rod-holder having a diameter sized to receive the rod may also be attached to the body. A plurality of hooks configured to engage the rod when the rod is woven into the fence may also be attached to the body. An interface may also be attached to the body. Using this system, fence may be quickly and easily stretched with minimal link displacement.

17 Claims, 2 Drawing Sheets

FENCE STRETCHER SYSTEM

FIELD OF TECHNOLOGY

The present application claims priority to provisional application Ser. No. 61/054,955. The present inventions relate to systems and methods for stretching fence. More particularly, the present inventions relate to a system and method for pulling fence having substantially rectangular shaped links.

RELATED ART

Fence stretchers for pulling fence having substantially rectangular shaped links are known in the art. Most commonly, they include long-vertically oriented clamps that are clamped onto sections of fence by tightening a series of bolts, usually about 3-5 bolts. Although these conventional stretchers perform with some degree of satisfaction, they are labor intensive to use. For example, for each use: (1) numerous large bolts must be unscrewed; (2) the fence must be properly oriented in the clamp; and (3) the numerous large bolts must be tightened. This process can take several minutes (e.g., about 5), each time a section of fence is to be stretched. When stretching numerous sections of fence, the attachment of conventional clamps can take hours. Further, bolts and nuts of the clamp are easily dropped and lost in the high grass environments in which fence is usually installed.

It is to these and other problems that the present invention is directed.

SUMMARY

In summary, the present inventions include a fence stretcher system and method. In one embodiment, the fence stretcher system comprises a body. A rod having a diameter configured to allow the rod to be woven into a fence's links may be attached to the body. A rod-holder having a diameter sized to receive the rod may also be attached to the body. A plurality of hooks configured to engage the rod when the rod is woven into the fence may also be attached to the body. An interface may also be attached to the body.

In another embodiment, the present invention includes a method of stretching fence. In this embodiment, the method includes the step of obtaining a section of fence having substantially rectangular links. Typically, the rectangular links will have substantially horizontal tops and bottoms, and substantially vertical sides. The method includes obtaining a fence stretching system having a body, a plurality of hooks mounted to said body, a rod-holder, and a rod removably positioned within said rod holder. The method includes removing the rod from the rod-holder. The method includes weaving the rod into the links of the fence. The method includes positioning the rod against the vertical sides of the links. The method includes engaging the rod woven into the fence with hooks of the fence stretching system. The method also includes stretching the fence.

The above summary was intended to summarize certain embodiments of the present inventions. Systems and methods of the present inventions will be set forth in more detail, in the figures and detailed description below. It will be apparent, however, that the detailed description is not intended to limit the present inventions, the scope of which should be properly determined by the appended claims.

DETAILED DESCRIPTION OF SOME EMBODIMENTS

Figure 1A:
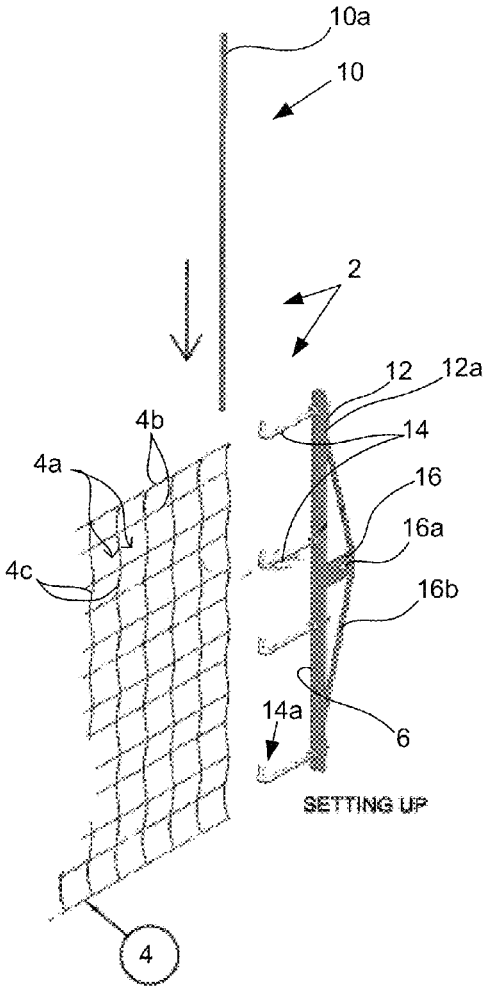
FIG. 1*a* shows one embodiment of the invention adjacent to a fence.

FIG. 1*a* shows one embodiment of a system 2 of the present invention. FIG. 1*a* also shows a fence 4 having substantially rectangular shaped links 4*a*. As seen, links 4*a* include substantially horizontal tops and bottoms 4*b*, and substantially vertical sides 4*c*. As used herein, a square link is considered to be a rectangular-shaped link having approximately equal sides.

System 2 includes body 6, which may be, for example, tubular or square metal or steel, or another material of sufficient rigidity. In typical embodiments, body 6 has a height substantially similar to the height of the fence, i.e., body height=fence height±(fence height)(0.2). In other embodiments, body 6 has a height similar to the height of fence, i.e., body height=fence height±(fence height)(0.3). Other embodiments may be up to two times the height of fence 4 or about half the height of fence 4. In most embodiments, the height of body 6 will be about 42 inches.

System 2 includes rod 10. Rod 10 has a diameter configured to be woven into fence 4's rectangular shaped links. The diameter of rod 10 is also typically sufficient to withstand the significant pulling force often required to stretch fence. In most embodiments, the diameter of rod 10 will be ¼ inch to about 1 inch. Rod 10 will typically have a height similar to the height of the fence to be stretched, for example, about 42 inches. Still, other sizes and shapes are in the scope of the present invention.

Figure 2:
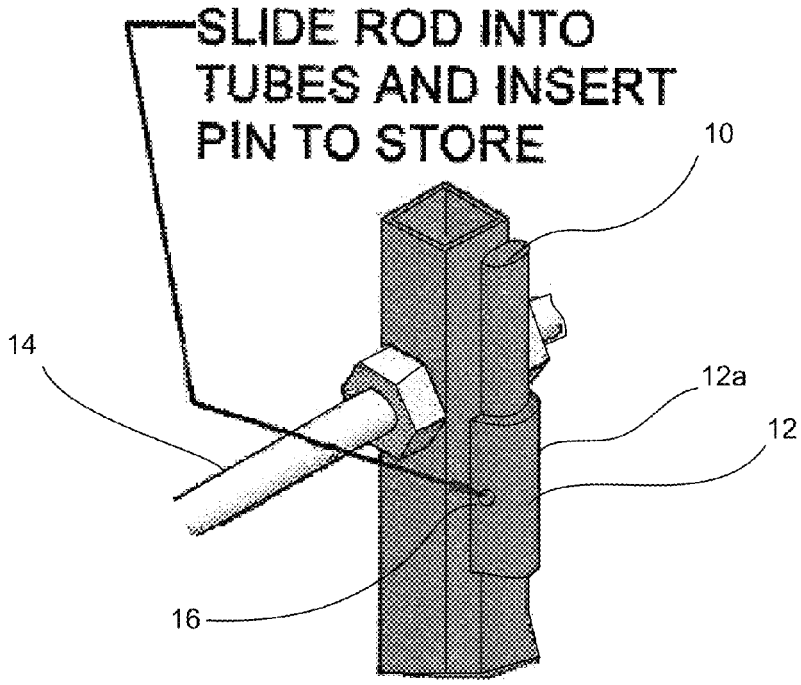
FIG. 2 shows a close up of the embodiment of the previous figures.

System 2 may include rod-holder 12 mounted to body 6 (see also FIG. 2 showing a close-up of rod-holder 12). In this embodiment, rod holder 12 is substantially cylindrical, and includes a diameter sized to receive rod 10. Other embodiments, include rod-holders of a different shape, e.g., square and rods of a different shape, e.g., square. Usually, rod 10 defines a first aperture 10*a* and rod-holder 12 defines a second aperture 12*a* of similar size to the first aperture. In such embodiments, apertures 10*a* and 12*a* are configured to be alignable when rod 10 is positioned within rod-holder 12. A pin may be positioned through aligned apertures at point 13. Typically, rod-holder 12 is mounted on a side of body 6 that does not include plurality of hooks 14.

Hooks 14 are attached to body 6. As shown, hooks include open-hook shape 14*a* at a portion distal from body 6. Hooks 14 are configured to engage rod 10 when rod 10 is woven into fence 4. As used herein, hooks is inclusive of closed-hook shapes as well. For example, another embodiment of the invention includes a closed-hook shape, e.g., a carabineer type of system. Still others may desire other hook shapes, all of which are within the scope of the present invention. Hooks can be as short or as long as desired, but will typically range from about 1" to about 5". In most embodiments, hooks 14 are vertically spaced along rod 6, most typically, along a single side of body 6. Hooks 14 may be attached to body 6 in a variety of ways. For example, in one embodiment, hooks 14 are welded to body 6. In another embodiment, hooks 14 threadably connect to body 6, thereby allowing hook removal and adjustment. Most typically, hooks will be adjustably attached, e.g., by threading, to allow for each hook to achieve adequate contact with a rod placed into a fence. Such a configuration is beneficial, inter alia, when fences are non-uniform, when rods become bent through excessive use, or when hooks become bent through excessive use.

System 2 also includes interface 16. In most embodiments, interface 16 is positioned substantially opposite hooks 14. Typically, interface 16 defines an aperture 16*a* through which a pulling device, e.g., a winch, can be attached. Typically, interface 16 will be somewhat u-shaped or oblong, e.g., to allow the link of a chain to pass there through.

As depicted, interface 16 is positioned at the approximate midpoint of body 6. For example, if body 6 has height H, interface 16 is positioned at approximately H/2, which allows for relatively even force distribution through a single point of attachment. Still other embodiments include other points of attachment. In many embodiments, interface 16 will also include support arms 16*b*.

Figure 1B:
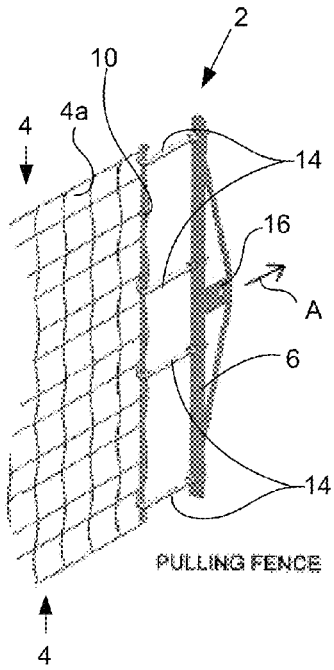
FIG. 1*b* shows the embodiment of FIG. 1*a* engaged with the fence of 1*a;*
Figure 1C:
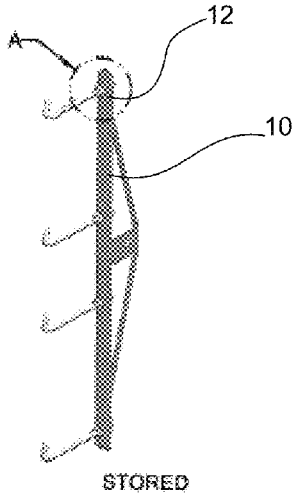
FIG. 1*c* shows the embodiment of FIG. 1*a* in a different configuration.

In operation, a user will obtain a section of fence to be stretched, e.g., fence 4, and a system according to the present inventions, e.g., system 2. Rod 10 will be removed from rod holder 12 of system 2. As seen in FIG. 1*b*, rod 10 is woven into links 4*a* of fence 4. Typically, rod 10 will be positioned against the vertical sides 4*c* of links 4*a*. Rod 10 woven into fence 4 is then engaged with hooks 14 of system 2. Fence 4 can then be quickly and efficiently stretched by pulling body 6, e.g., through interface 16, in the direction of arrow A. When fence 4 has been stretched the desired distance, it may be attached to a fence post (not shown), e.g., a wooden post set in the ground. Rod 10 is removed from fence 4, and may be returned to rod-holder 12, for example, as seen in FIG. 1*c*.

Using the systems and methods of the present invention, applicant surprisingly found that fence can be quickly and easily stretched without the time-consuming clamping required by the related technology. Further, applicant surprisingly found that the present inventions produce essentially no deformation of the substantially vertical sides of the rectangular links.

Numerous characteristics and advantages have been set forth in the foregoing description, together with details of structure and function. The novel features are pointed out in the appended claims. The disclosure, however, is illustrative only, and changes may be made in detail, especially in matters of shape, size, and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety. It is further noted that, as used in this specification, the singular forms "a," "an," and "the" include plural referents unless expressly and unequivocally limited to one referent.

What is claimed is:

1. A fence stretcher system for stretching a fence having a height F, said system comprising:

a body having a top end, a bottom end, and a length there between, wherein said body has a height H, wherein H=F±(F)(0.3);

a linear rod having a diameter and shape configured to allow said rod to be woven into a fence's rectangular shaped wire links and abut the sides of the wire links adjacent to the rod, wherein said rod is not required to form part of a clamp for clamping said wire links and stretching said fence, and wherein said rod is not part of said fence;

a rod-holder mounted to said body, said rod-holder having a diameter sized to receive said rod;

a plurality of rigid hooks having terminal ends, wherein said terminal ends are configured to engage said linear rod along its linear portion when said rod is woven into said fence, wherein said rigid hooks are not part of said fence, and wherein at least one of said plurality of hooks is positioned along the length of the body; and an interface mounted on said body.

2. The system of claim 1, wherein said body has a height similar to the height of the fence to be stretched.

3. The system of claim 1, wherein said rod has a height similar to the height of the fence to be stretched.

4. The system of claim 1, wherein said rod-holder is mounted on a side of said body that does not contain said plurality of hooks.

5. The system of claim 1, wherein said plurality of hooks are vertically spaced on a single side of said rod.

6. The system of claim 1, wherein said plurality of hooks are adjustably attached to said body.

7. The system of claim 1, wherein said plurality of hooks are threadably connected to said body.

8. The system of claim 1, wherein said plurality of hooks are positioned on the body substantially opposite said interface.

9. The system of claim 1, wherein said interface defines an aperture.

10. The system of claim 1, wherein said body has a height H, and wherein said interface is positioned on said body at about H/2.

11. The system of claim 1, wherein said interface includes support arms.

12. The system of claim 1, wherein said rod defines a first aperture and wherein said rod-holder defines a second aperture having a diameter substantially similar to the diameter of said first aperture, and wherein said first and second apertures are configured to align when said rod is positioned within said rod-holder.

13. The system of claim 12, further including a pin for positioning through said first and second apertures when said apertures are aligned.

14. A method of stretching fence comprising the steps of:

obtaining a section of fence having substantially rectangular links including substantially horizontal tops and bottoms, and substantially vertical sides;

obtaining a fence stretching system comprising a body, a plurality of hooks mounted to said body, a rod-holder, and a linear rod removably positioned within said rod holder;

removing said rod from said rod-holder;

weaving said rod into said links of said fence;

positioning said rod against said vertical sides of said links;

engaging said rod woven into said fence with said hooks of said fence stretching system, wherein said hooks engage said rod along its linear portion; and stretching said fence, wherein said stretching does not require the use of said rod as a clamp component.

15. The method of claim 14, further including attaching said fence to a post after said stretching.

16. The method of claim 15, further including removing said rod from said fence.

17. The method of claim 16, further including placing said rod into said rod-holder.

* * * * *